US005634832A

United States Patent [19]

Nakase et al.

[11] Patent Number: 5,634,832

[45] Date of Patent: Jun. 3, 1997

[54] INDUCTION SYSTEM FOR FOUR-CYCLE WATERCRAFT ENGINE

[75] Inventors: Ryoichi Nakase; Masayoshi Nanami, both of Hamamatsu, Japan

[73] Assignee: Sanshin Kogyo Kabushiki Kaisha, Hamamatsu, Japan

[21] Appl. No.: 386,557

[22] Filed: Feb. 10, 1995

[30] Foreign Application Priority Data

Feb. 28, 1994 [JP] Japan ..... 6-030516

[51] Int. Cl.[6] ..... B63H 21/10

[52] U.S. Cl. ..... 440/88

[58] Field of Search ..... 440/88, 89, 38; 114/270

[56] References Cited

U.S. PATENT DOCUMENTS 4,972,809 11/1990 Hirasawa ..... 440/89

5,096,446 3/1992 Tazaki et al. ..... 440/89

5,212,949 5/1993 Shiozawa ..... 440/89

FOREIGN PATENT DOCUMENTS 4201797 7/1992 Japan .

*Primary Examiner*—Stephen Avila

*Attorney, Agent, or Firm*—Knobbe, Martens, Olson & Bear LLP

[57] ABSTRACT

A number of embodiments of engine induction system configurations for adapting four-cycle, multi-cylinder engines for use in small, personal watercraft. This is accomplished by canting the engine at an angle to a vertically extending plane and positioning the induction system on the upper portion of the cylinder head. Various configurations of manifold and carburetor locations are disclosed so as to achieve this purpose.

21 Claims, 4 Drawing Sheets

INDUCTION SYSTEM FOR FOUR-CYCLE WATERCRAFT ENGINE

BACKGROUND OF THE INVENTION

This invention relates to a four-cycle watercraft engine and more particularly to an improved induction system for such engines.

There is a very popular type of small watercraft that is designated as a "personal" watercraft. This type of watercraft is quite compact in nature and frequently accommodates the operator and/or passengers seated in a straddle fashion. Where more than one occupant is present, the occupants frequently ride in a tandem fashion.

It has been generally the practice to employ as prime movers for such watercraft two-cycle engines. Two-cycle engines have a number of advantages, the prime of which is the relatively compact construction of such engines. In addition, with crankcase compression two-cycle engines, the induction and exhaust systems can be positioned relatively low on the engine and thus the engine can be quite compact in configuration.

This compact configuration is particularly important when the engine is disposed so that it is positioned beneath the seat of the watercraft. Using the tandem straddle-type seat arrangement, the seat is relatively narrow and tapers outwardly in a downward direction. Hence, two-cycle engines are particularly adapted for positioning beneath such seats.

There are, however, certain reasons why four-cycle engines may be more advantageous for use in such watercraft. Four-cycle engines may, in some instances, be more environmentally friendly and thus they are being considered for this type of application.

However, a four-cycle engine, particularly a high output engine, has the induction and exhaust system normally positioned at the upper end of the engine and generally mounted directly to the cylinder head. Thus, unlike a two-cycle engine where the induction and exhaust systems are difficulties in positioned low and adjacent the crankshaft, four-cycle engines place these components higher in the cylinder block or directly on the cylinder head. This gives rise to positioning the engine under a seat of the aforenoted type.

It is, therefore, a principal object of this invention is to provide an improved four-cycle engine configuration that lends itself for use in personal type watercraft.

It is a further object of this invention to provide an improved, compact induction system and layout for a four-cycle engine.

It is a further object of this invention to provide an improved, compact induction system for a four-cycle internal combustion engine so as to adapt it for watercraft usage.

SUMMARY OF THE INVENTION

This invention is adapted to be embodied in a watercraft having a hull defining an engine compartment, a propulsion unit for the watercraft and an engine in the engine compartment driving the propulsion unit. The engine comprises a crankcase chamber in which a crankshaft which is coupled to the propulsion unit is journaled. A cylinder block extends from the crankcase chamber and defines at least one cylinder bore containing a piston for driving the crankshaft. A cylinder head is affixed to the cylinder block and closes the cylinder bore. An intake passage is formed in the cylinder head and extends from the cylinder bore to an inlet opening in a side of the cylinder head. The engine is supported within the hull so that the cylinder head side faces at least partially upwardly. An induction system supplies at least an air charge to the cylinder head intake passage.

DETAILED DESCRIPTION OF THE PREFERRED EMBODIMENTS

Figure 1:
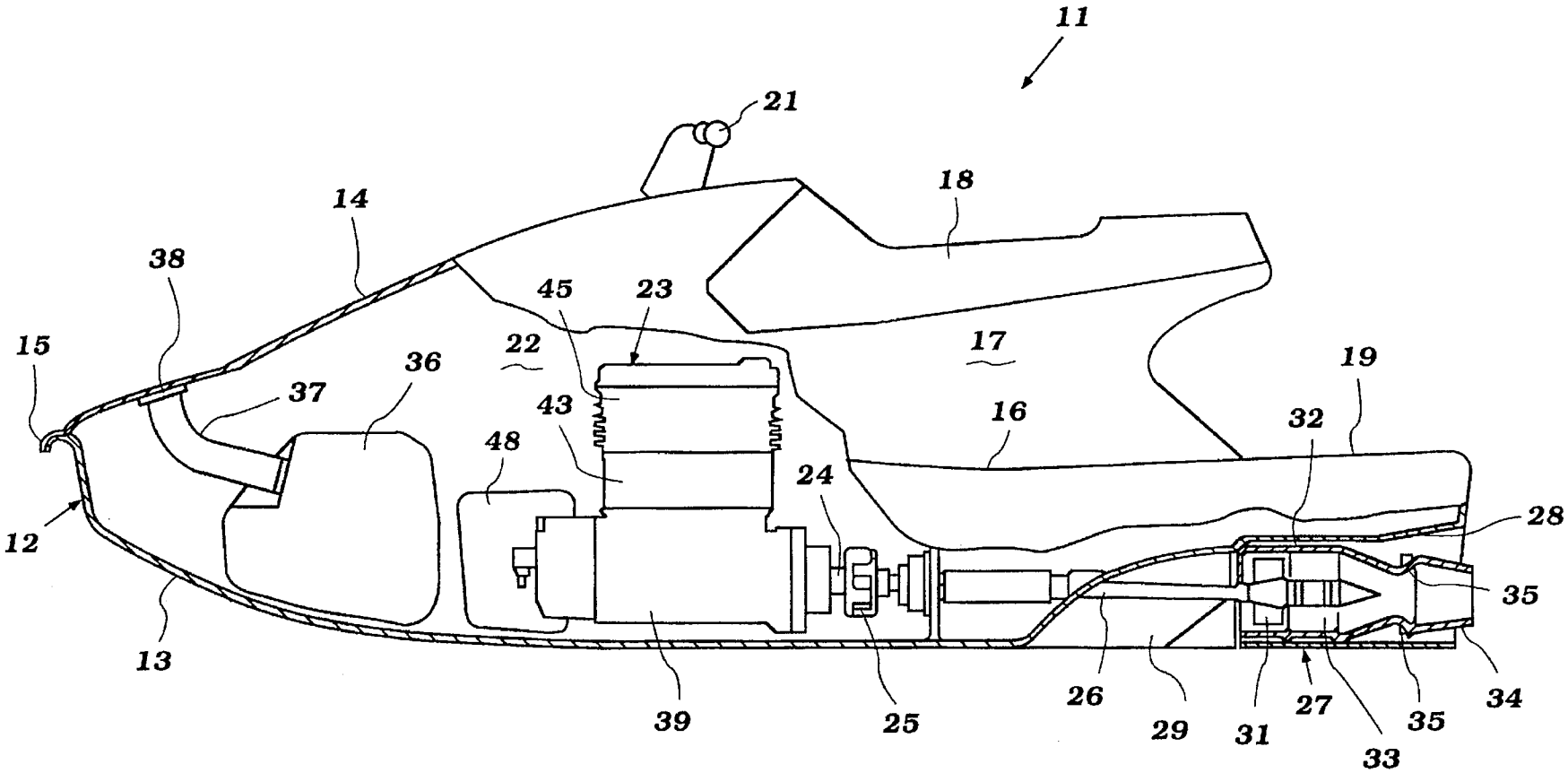
FIG. 1 is a side elevational view of a personal watercraft constructed in accordance with an embodiment of the invention, with portions broken away and other portions shown in section.
Figure 2:
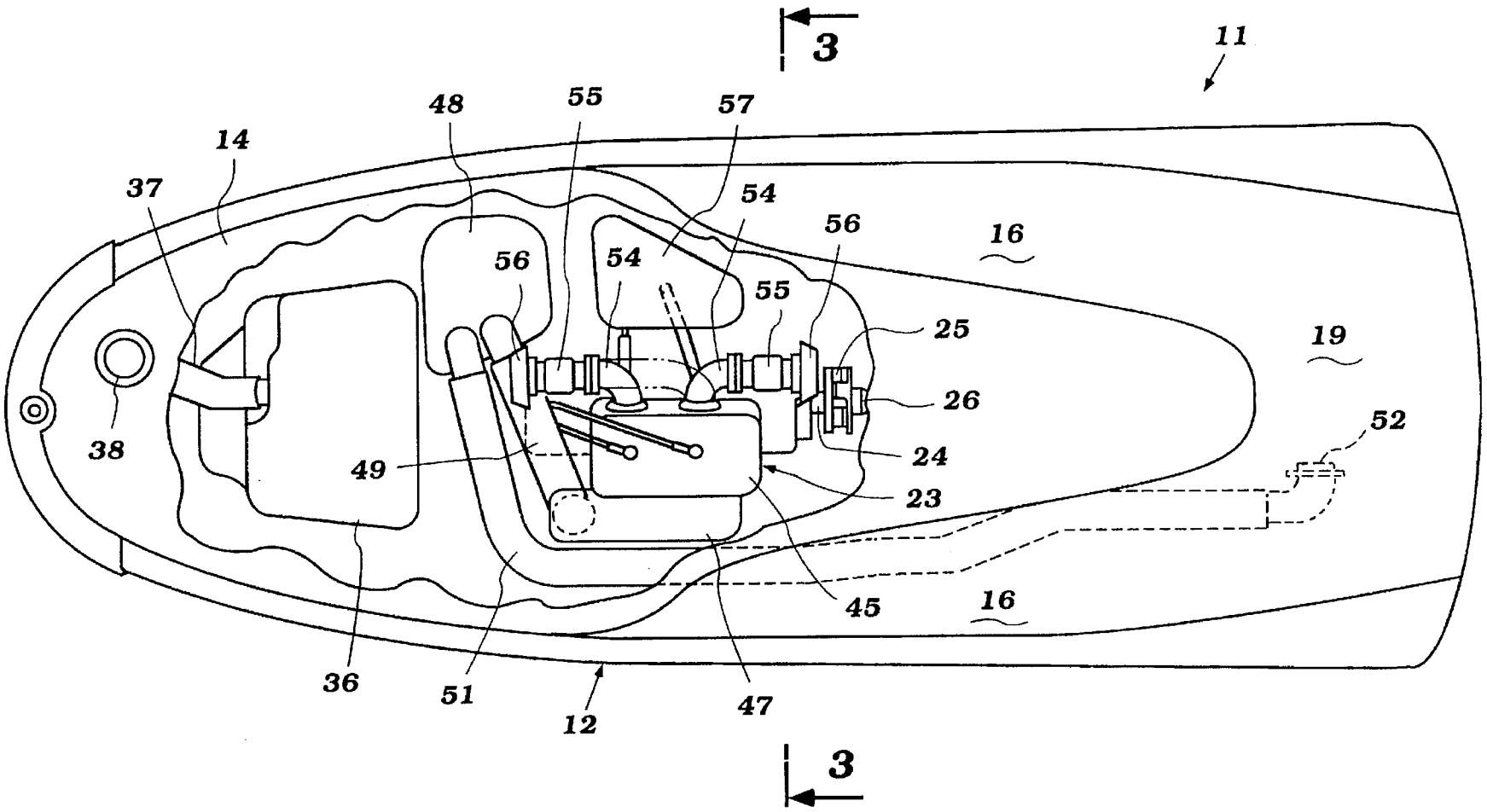
FIG. 2 is a top plan view of the watercraft with other portions broken away.

Referring in detail to the drawings and initially primarily to FIGS. 1 and 2, a personal watercraft constructed in accordance with an embodiment of the invention is identified generally by the reference numeral 11. Although the invention is described in conjunction with a personal watercraft, it will be readily apparent to those skilled in the art that the invention may be employed in a wide variety of other applications. However, and as has been previously noted, the invention has particular utility in conjunction with personal watercraft because of their compact nature.

Also, it should be understood that the configuration of the personal watercraft 11, which will be described, is typical of those in which the invention may be practiced. Again, the invention is capable of use with watercraft having other configurations. The invention, however, also has particular utility in conjunction with watercraft having seats of the type which will be described and those having seats where the rider or riders sit in straddle fashion, as will become apparent.

The watercraft 11 is comprised of a hull, indicated generally by the reference numeral 12 which is comprised of a lower hull portion 13 and an upper deck portion 14. The hull and deck portions 13 and 14 are formed from a suitable material such as a molded, fiberglass-reinforced resin or the like. The hull and deck portions 13 and 14 are secured to each other along mating edges which form a gunnel 15 in any known manner.

To the rear of the deck portion 14 there is provided a rider's area which is comprised of a pair of foot areas 16 disposed on opposite sides of a raised pedestal 17 which supports a seat cushion 18 on its upper side. In this particular seating configuration, a rider rides the watercraft 11 in a semi-standing position, much like a motorcycle. A passenger may be seated in tandem fashion behind a rider on the seat cushion 18 and/or standing on a rear deck area 19 formed to the rear of the pedestal 17 and which bridges the foot areas 16. As has been previously noted, this particular configuration is just typical of those in which the invention may be utilized. As may be seen best in FIG. 3, the raised area 17 has a generally curved configuration that tapers outwardly so that the riders on the seat cushion 18 can have a comfortable leg and seating position.

Positioned on the deck 14 forwardly of the seat cushion 18 is a handlebar assembly 21 for control of the watercraft 11. The handlebar assembly 21 is employed for steering the watercraft 11, in a manner which will be described and also for control of the throttle of the powering internal combustion engine. In addition, other controls such as kill switches, starter switches, etc., may be carried on the handlebar assembly 21.

The hull portion 13 and deck portion 14 form an engine compartment area, indicated generally by the reference numeral 22 which is disposed in part beneath the control handlebar assembly 21 and the forward portion of the seat cushion 18. The pedestal 17 also defines this engine compartment. An internal combustion engine, indicated generally by the reference numeral 23, is disposed in this engine compartment 22 and extends also beneath the handlebar assembly 21 and the forward portion of the seat cushion 18. This engine also lies within the pedestal 17 as should be readily apparent. The engine 23 has a construction as will be described in more detail later.

However, the engine includes a crankshaft 24 which is journaled in a manner to be described and extends rearwardly to a coupling 25. The coupling 25 connects the crankshaft 24 to an impeller shaft 26 of a jet propulsion unit, indicated generally by the reference numeral 27 and which provides the propulsion unit for the watercraft 11.

This jet propulsion unit 27 is mounted in a suitable manner in a tunnel 28 that is formed centrally in the underside of the rear part of the hull portion 13. The jet propulsion unit 27 and tunnel 28 form a downwardly facing water inlet opening 29 through which water is drawn by an impeller 31 that is affixed to the impeller shaft 26 and which is journaled within an outer housing 32 of the jet propulsion unit 27 by means including a nacelle formed at the center of a plurality of straightening vanes 23.

Water pumped by the impeller 31 is discharged rearwardly through a steering nozzle 34 that is journaled for steering movement about a vertically extending steering axis by the outer housing 32 on pivot pins 35. The steering nozzle 34 is coupled by means of a bowden wire actuator (not shown) or the like to the handlebar assembly 21 for steering of the direction in which the water is discharged by the steering nozzle 34 and, accordingly, steering of the watercraft 11 in a manner as is known in this art.

Certain ancillaries for the engine 23 are also mounted in the engine compartment 22 and these include a forwardly positioned fuel tank 36 which is disposed generally on the longitudinal center line of the watercraft. The fuel tank 36 has a fill neck 37 to which a filler cap 38 is affixed. The fill neck 37 extends to the forward portion of the deck 14 and the filler cap 38 is externally positioned so that the tank 36 may be easily refilled.

The construction of the engine 23 will now be described by reference to FIGS. 1–3. In the illustrated embodiment, the engine 23 is comprised of an in-line, two-cylinder, twin overhead camshaft engine operating on a four-stroke principle. As should be readily apparent from the foregoing description, the invention has particular utility in adapting such four-stroke engines for use in small, personal watercraft like the watercraft 11.

The engine 23 is comprised of a crankcase assembly 39 which is mounted in the hull 12 and specifically on the hull under-portion 13 by means of elastic isolators 41 in a well known manner. The crankcase assembly 39 forms a crankcase chamber 42 in which the crankshaft 24 is rotatably journaled in any well known manner. The crankcase assembly 39 is mounted so that the crankshaft 24 rotates about an axis which lies substantially on a longitudinally extending center plane L of the watercraft 11 and specifically its hull 12.

However, in accordance with an important feature of the invention, a cylinder block 43 extends upwardly from the crankcase chamber 39, but is inclined at an acute angle to the plane L. This construction shows clearly in FIG. 3 wherein the cylinder block 43 is canted to the left side of the plane L.

The cylinder block 43 forms a pair of in-line cylinder bores (not shown) that have their axes lying on a common plane that is disposed at an acute angle to the plane L. These cylinder bores slidably support pistons (not shown) which are connected to the crankshaft 24 for driving it through connecting rods 44 in a manner well known in the art.

A cylinder head assembly 45 is affixed to the cylinder block 43 in a well known manner and has combustion chamber recesses which cooperate with the cylinder bores in the cylinder block 43, and the heads of the pistons to form the combustion chambers. Twin overhead camshafts 46 are journaled in the cylinder head assembly 45 and actuate a valve mechanism for controlling the admission of a burnt charge to these combustion chambers and the discharge of the charge from the combustion chambers.

Figure 3:
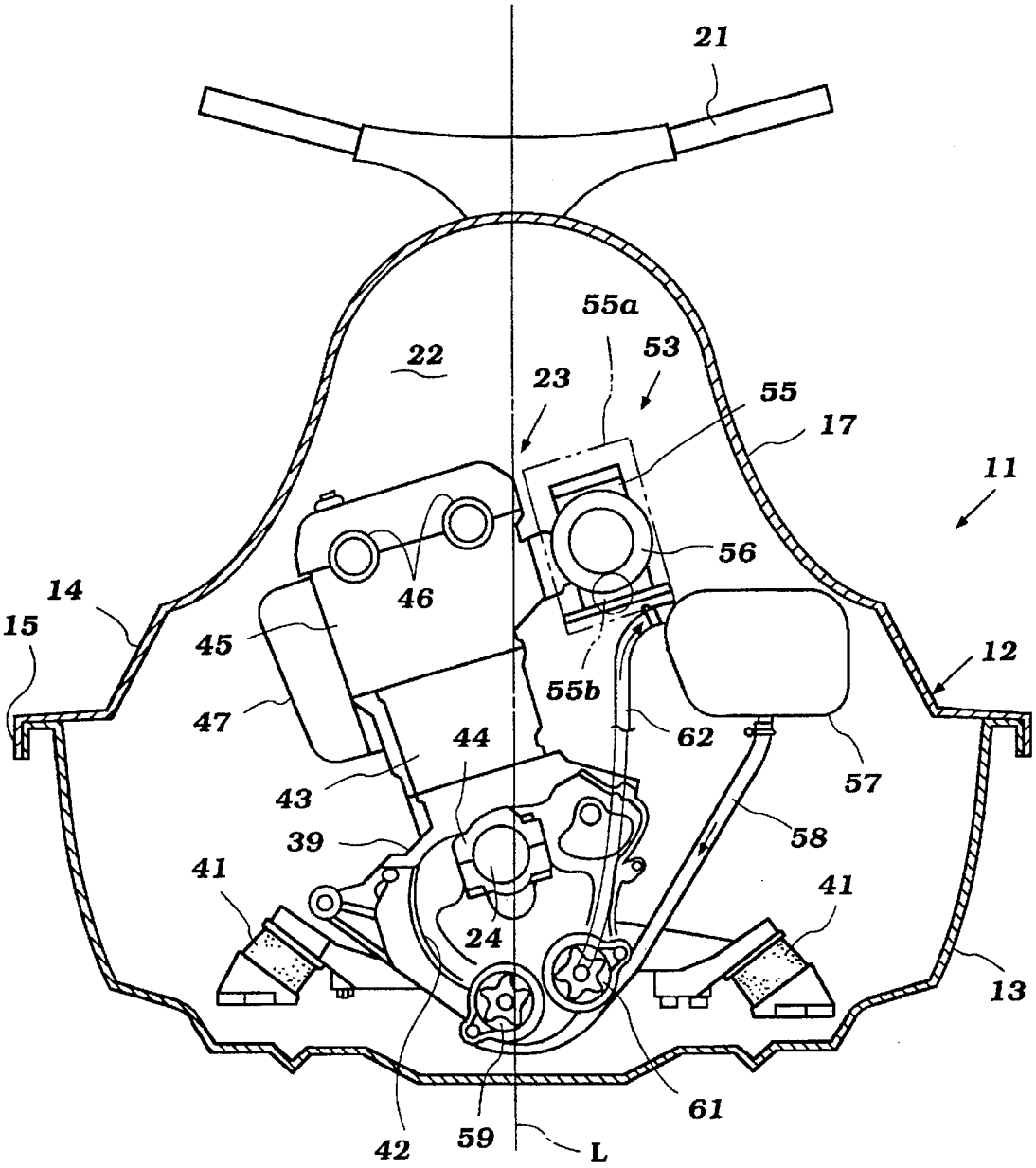
FIG. 3 is an enlarged cross-sectional view taken along the line 3—3 of FIG. 2.

The left-hand side of the cylinder head 45 as shown in FIG. 3 is the exhaust side and the exhaust passages which are formed in the cylinder head 45 in a well known manner deliver the exhaust gases to an exhaust manifold, indicated generally by the reference numeral 47, which is affixed to this side of the cylinder head 45. The exhaust manifold 47 may, as is typical with marine practice, be water-cooled and may provide an arrangement wherein the coolant from the engine 23 not only circulates through the manifold 47 for cooling the exhaust gases, but is also mixed with the exhaust gases at some point for cooling and silencing them.

The exhaust manifold 47 may include an expansion section and communicates with a water trap device, indicated generally by the reference numeral 48 through a conduit 49. The water trap device 48 is mounted on the side of the engine 23 opposite the exhaust manifold 47 and functions, as is well known in this art, to preclude water from entering the engine through the exhaust system from the body of water in which the watercraft is operating.

An exhaust pipe 51 extends from the water trap device 48 back across the front of the engine 23 and then along the side of the tunnel 28 to a discharge end 52 through which the exhaust gases and water are discharged back into the body of water in which the watercraft is operating through the tunnel 28. This provides not only a neat appearance, but also will insure that the exhaust gases do not soil the exterior surface of the watercraft hull 12.

Because the engine is canted to one side as shown in FIG. 3, it is possible to use a relatively large expansion chamber, exhaust manifold 47 since this will be positioned toward the lower end of the raised hull portion 17 where it has a greater width as clearly shown in FIG. 3.

In a like manner, this canting of the engine 23 to one side permits its induction system, indicated generally by the reference numeral 53 to be positioned on the intake side of the engine and still have adequate room to clear the raised hull pedestal 17.

The cylinder head 45 forms intake passages that terminate in inlet openings in the side of the cylinder head 45 spaced from the exhaust manifold 47. These inlet openings face partially upwardly because of the canting of the cylinder block 43.

In this embodiment, a pair of right-angled exhaust manifolds 54 are affixed to the intake side of the cylinder head 45 and then turn and run longitudinally of the watercraft. The forward-most intake manifold 54 extends forwardly where the rearward exhaust manifold 54 extends rearwardly.

Carburetors 55 of any known type are affixed to an supply a fuel air charge to the manifolds 54. In turn, air inlet devices 56 which may include integral silencing sections, collect air from within the engine compartment 45 and supply it to the carburetors 55. As may be seen in FIG. 3, this disposition of the induction system 53 permits it to be located conveniently within the engine compartment 22 without interfering with the spacial requirements.

In the embodiment shown in solid lines in FIG. 3, the air inlet devices 56 are generally cylindrical in configuration and have annular air inlet openings. However, the space afforded by the canting of the engine 23 also will permit the use of larger, rectangular air inlet devices, indicated at 55*a* in phantom in FIG. 3, and which have air inlet openings 55*b* as also shown in phantom in this figure.

The type of watercraft in which this invention has particular utility (personal watercraft) also are somewhat prone to partial or total capsizing, as is well known by their users. In order to facilitate this possibility, the engine 23 is also provided with a dry sump lubrication system. This system includes an oil tank 57 which is disposed in the hull 12 on the same side of the longitudinal center plane L as to the water trap device 48.

Since the engine 23 is canted toward the other side of the plane L, this tends to improve the side-by-side balance while maximizing the usable space in the hull and specifically the engine compartment 12. The dry sump lubricant tank 57 supplies lubricant to the engine through a conduit 58 which supplies a pressure pump 59. The pressure pump 59 circulates the lubricant to the engine 23 through any well known lubricating system.

Lubricant which has been circulated through the engine is returned to the crankcase chamber 42 where it is picked up by a scavenge pump 61 and returned to the lubricant tank 57 through a conduit 62.

Figure 4:
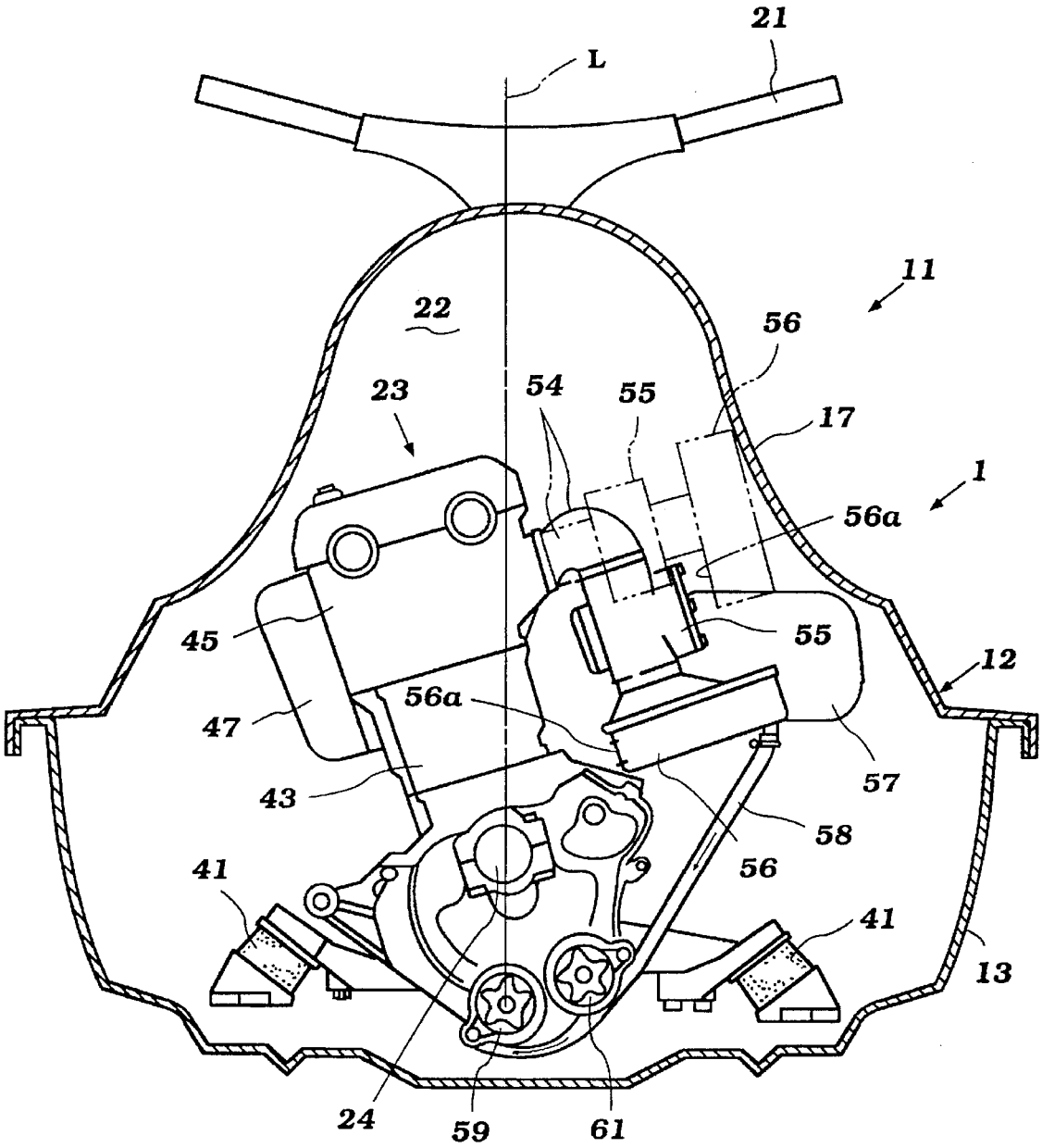
FIG. 4 is a cross-sectional view, in part similar to FIG. 3 and shows another embodiment of the invention.

In the embodiment of the invention as thus far described, the intake manifolds 54 have been configured to extend at right angles and one of their legs extended in a longitudinal direction. FIG. 4 shows another embodiment of the invention wherein the intake manifolds 54 are also bent at a right angle, but in this embodiment extend downwardly rather than longitudinally. Therefore, the carburetors 55, which may be of the updraft type in this embodiment, attach to the lower ends of the manifolds 54. The air inlet devices 56 having their inlet openings 56*a* are affixed to the lower ends of the carburetors 55. Again, this arrangement provides compact assembly and also maximum space utilization.

Because of the fact that the engine 23 is canted, it also would be possible to use a more conventional, generally straight intake manifold as shown in phantom lines in FIG. 4 that extends perpendicularly to the side of the cylinder head on which the intake passages are formed. Still, the inlet openings for the cylinder head intake passages extend generally upwardly and the carburetors 55 and air inlet devices 56 may, in this embodiment, also extend in a straight line. The inlet openings 56*a* for the air inlet devices 56 in this embodiment will be formed on the side facing the cylinder head 45.

It should be readily apparent from the foregoing description that the described embodiments of the invention provide a very compact engine assembly for a small personal watercraft and one in which the induction system can be readily accommodated due to the canting of the engine from an upright position. Of course, the foregoing description is that of preferred embodiments of the invention, and various other changes may be made without departing from the spirit and scope of the invention, as defined by the appended claims.

We claim:

1. A watercraft having a hull defining an engine compartment, a propulsion unit for said watercraft, and an engine in said engine compartment driving said propulsion unit, said engine comprising a crankcase chamber in which a crankshaft coupled to said propulsion unit is journaled, a cylinder block extending from said crankcase chamber and defining at least one cylinder bore containing a piston for driving said crankshaft, a cylinder head affixed to said cylinder block and enclosing said cylinder bore, an intake passage formed in said cylinder head and extending from said cylinder bore to an inlet opening in an outer surface of said cylinder head on a side of said cylinder head, said engine being supported in said hull so that said cylinder head side faces at least partially upwardly, and an induction system detachably connected to said cylinder head side outer surface for supplying an air charge to said cylinder head intake passage.

2. A watercraft having a hull defining an engine compartment as set forth in claim 1, wherein the cylinder block has a plurality of in-line cylinder bores, the cylinder head having a plurality respective intake passages, at least one for each cylinder bore.

3. A watercraft having a hull defining an engine compartment as set forth in claim 1, wherein the cylinder block is inclined at an acute angle to a longitudinally extending vertical plane with the axes of the cylinder bores all lying in a common plane disposed at the acute angle.

4. A watercraft having a hull defining an engine compartment as set forth in claim 3, wherein the crankshaft axis is disposed substantially on the longitudinal center plane of the watercraft.

5. A watercraft having a hull defining an engine compartment as set forth in claim 1, wherein the hull has an upper deck portion that tapers generally inwardly in an upward direction and wherein the cylinder head and induction system is disposed in the upwardly tapering portion of the hull.

6. A watercraft having a hull defining an engine compartment as set forth in claim 5, wherein the upwardly tapering portion of the hull defines in part a passengers' area for the hull.

7. A watercraft having a hull defining an engine compartment as set forth in claim 6, wherein there is provided a seat at the upper extremity of the upwardly extending hull portion.

8. A watercraft having a hull defining an engine compartment as set forth in claim 7, wherein the seat affords a straddle-type seating arrangement for the watercraft occupant.

9. A watercraft having a hull defining an engine compartment as set forth in claim 2, wherein the induction system comprises a plurality of right-angled configuration intake manifolds, each serving a respective cylinder head intake passage.

10. A watercraft having a hull defining an engine compartment as set forth in claim 9, further including a carburetor affixed to each of said manifolds.

11. A watercraft having a hull defining an engine compartment as set forth in claim 10, wherein the legs of the intake manifolds to which the carburetors are affixed extend longitudinally of the watercraft.

12. A watercraft having a hull defining an engine compartment as set forth in claim 10, wherein the legs of the manifolds to which the carburetors are affixed extend in a plane parallel to the plane in which the cylinder bore axes lie.

13. A watercraft having a hull defining an engine compartment as set forth in claim 2, wherein the induction system comprises a plurality of intake manifolds, carburetors and air inlet devices, all extending in a generally straight line from the cylinder head surface.

14. A watercraft as set forth in claim 2, wherein the cylinder block is inclined at an acute angle to a longitudinally extending vertical plane containing the axis of rotation of the crankshaft, the acute angle being such that the cylinder block lies substantially on one side of the plane and the induction system lies substantially on the other side of the plane.

15. A watercraft as set forth in claim 14, wherein the crankshaft axis is disposed substantially on the longitudinal center plane of the watercraft.

16. A watercraft having a hull defining an engine compartment as set forth in claim 15, wherein the hull has an upper deck portion that tapers generally inwardly in an upward direction and wherein the cylinder head and induction system is disposed in the upwardly tapering portion of the hull.

17. A watercraft having a hull defining an engine compartment as set forth in claim 16, wherein the upwardly tapering portion of the hull defines in part a passengers' area for the hull.

18. A watercraft having a hull defining an engine compartment as set forth in claim 17, wherein there is provided a seat at the upper extremity of the upwardly extending hull portion.

19. A watercraft having a hull defining an engine compartment as set forth in claim 18, wherein the seat affords a straddle-type seating arrangement for the watercraft occupant.

20. A watercraft as set forth in claim 1 wherein the induction system has an atmospheric air inlet opening formed within the hull and which is disposed at a level that is lower than the level of the inlet opening.

21. A watercraft as set forth in claim 1 wherein the induction system extends in a generally straight line from the intake passage inlet opening to an atmospheric air inlet opening within the hull.

* * * * *